United States Patent [19]

Schneider

[11] Patent Number: 4,930,371

[45] Date of Patent: Jun. 5, 1990

[54] APPARATUS FOR LOCKING A FLYWHEEL

[76] Inventor: William J. Schneider, Rte. 1, Box 339, E. Bernstadt, Ky. 40729

[21] Appl. No.: 278,379

[22] Filed: Dec. 1, 1988

[51] Int. Cl.[5] ..... G05G 5/06

[52] U.S. Cl. ..... 74/527; 74/572; 123/198 R; 411/393

[58] Field of Search ..... 74/527, 574, 572, 617; 411/393, 347, 348, 383; 123/198 R

[56] References Cited

U.S. PATENT DOCUMENTS

| | | | |
|---|---|---|---|
| 575,810 | 1/1897 | Rice | 74/574 X |
| 2,221,101 | 11/1940 | Lefkowitz | 74/527 X |
| 2,958,233 | 11/1960 | Johnson | 74/527 X |
| 4,580,534 | 4/1986 | Blum et al. | 123/198 R X |

FOREIGN PATENT DOCUMENTS

| | | | |
|---|---|---|---|
| 10990 | 11/1909 | France | 74/527 |
| 2017250 | 10/1979 | United Kingdom | 411/393 |

*Primary Examiner*—Rodney M. Lindsey
*Attorney, Agent, or Firm*—Kalish & Gilster

[57] ABSTRACT

Apparatus for locking a flywheel on an internal combustion engine whereby ignition timing can be efficiently accomplished. The apparatus includes a threaded, hollow body portion that can be threaded into a crankcase inspection hole. A shaft portion having a flat end adapted to fit into a flywheel timing mark is positioned within the hollow body portion. The flat end is maintained within the timing mark by a spring positioned in the hollow body portion.

7 Claims, 3 Drawing Sheets

APPARATUS FOR LOCKING A FLYWHEEL

BACKGROUND OF THE INVENTION

1. Field of the Invention

The present invention generally relates to a flywheel lock, and more particularly is concerned with an apparatus for locking a flywheel on an internal combustion engine so that ignition timing can be efficiently accomplished.

2. Description of the prior art

For proper engine operation and performance of a motorcycle engine, correct ignition timing and correct setting of the circuit breaker contact point gap is absolutely necessary. Therefore, it is essential to periodically check and reset ignition timing. This is generally accomplished by removing the engine circuit breaker cover and setting the circuit breaker contact gap at a setting prescribed by the engine manufacturer.

The first step in checking and adjusting ignition timing on a motorcycle is to correctly position the timing mark located on the engine flywheel. A generally accepted prior art practice first requires removing a screw plug from a bore that is located generally on the left side of the crank case. Removal of the screw plug exposes a timing inspection hole. The front push rod cover is then removed so that opening and closing of the engine valve can be observed. In order to position the timing mark located on the flywheel in the correct location, namely, within the inspection hole, the flywheel must be slowly rotated. This is accomplished by insuring that the front piston is on its compression stroke which occurs just after the front intake valve closes, continuing to slowly rotate the flywheel will bring the timing mark in correct alignment within the inspection hole.

However, certain disadvantages are implicit in this procedure. First, it is extremely difficult for one person to rotate a motorcycle flywheel while attempting at the same time to observe location of the timing mark on the flywheel and stop movement of the flywheel when the timing mark is observed within the inspection hole. Secondly, there is a certain amount of residual compression remaining within the engine that can cause the flywheel to move past the inspection hole. This movement will prevent the timing mark from remaining in position within the inspection hole.

One technique for positioning the timing mark within the inspection hole is to pry the flywheel into position by inserting a screw driver or some other type of long, blunt prying tool into the inspection hole. This technique can move the flywheel into position so that the timing mark is in the correct position. This practice can also cause damage to the internal threads on the bore wherein the inspection hole is located. In addition, this technique will not lock the flywheel in position so that residual compression in the engine can still cause the flywheel to move.

Consequently, a need exists for an apparatus that will result in greater reliability in locating an engine timing mark and then retaining the timing mark in correct position so that ignition timing can be effectively accomplished.

SUMMARY OF THE INVENTION

The present invention provides an apparatus that locates a timing mark on a motorcycle flywheel and retains the timing mark in position so that ignition timing can be effectively accomplished.

Accordingly, the present invention relates to an apparatus that can be inserted into a bore that contains the inspection hole located on a motorcycle crankcase. As the flywheel is slowly rotated, a shaft, maintained under tension by a spring, having a narrow flat surface on the end nearest the flywheel, locks into the timing mark as it slowly rotates into the inspection hole. The shaft is thereafter maintained in a locked relationship with the flywheel by the tension force exerted by the spring contained within the apparatus. The engine flywheel is prevented from movement thus retaining the timing mark within the inspection hole thereby permitting ignition timing to be checked and adjusted.

It is therefore an object of the present invention to provide an apparatus that can be inserted in a bore within a crankcase having an inspection hole for locating a timing mark and then retaining the timing mark at the correct location.

BRIEF DESCRIPTION OF THE DRAWINGS

FIGS. 8 and 10 are side elevational views of shaft portions of the flywheel locking apparatus of the present invention.

DESCRIPTION OF THE PREFERRED EMBODIMENT

Figure 1:
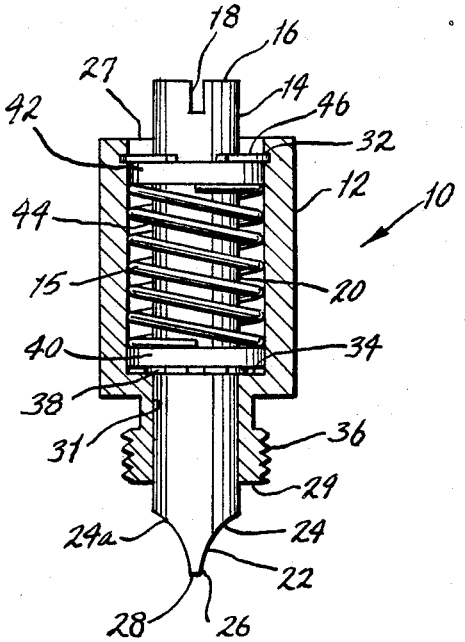
FIG. 1 is a schematic side elevational view of the flywheel locking apparatus of the present invention.

Referring now to the drawings, and more particularly to FIG. 1, there is shown an apparatus for locking a flywheel, generally designated 10, which comprises the preferred embodiment of the present invention. The apparatus basically includes a hollow body portion 12, a shaft portion 14 positioned axially within the body portion and means 46 for retaining the shaft portion in locking engagement with a flywheel as hereinafter more fully described.

Figure 3:
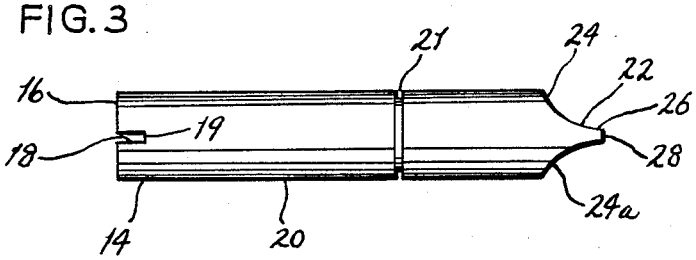
FIG. 3 is a side elevational view of the shaft portion of the flywheel locking apparatus of the present invention.

In the preferred embodiment of the apparatus 10 shown in FIGS. 1 and 3, shaft portion 14 principally includes a flat, first end 16, having a diagonal slot 18 with a width 19 provided therein, a longitudinal, cylindrical body portion 20, having an annular groove 21 and which terminates at second end 22. This second end includes a pair of convex surfaces 24 and 24*a* that form a flat end 26 having a width 28. It is a feature of shaft portion 14 wherein slot width 19 and flat end width 28 are essentially dimensionally equal and in the same horizontal plane.

Figure 2:
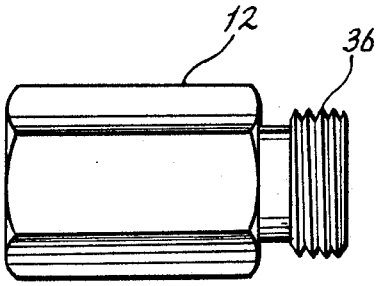
FIG. 2 is a side elevational view of the body portion of the flywheel locking apparatus of the present invention.

Also, as seen in FIGS. 1 and 2, hollow body portion 12 may generally be manufactured from hexagonal tool steel stock such as AISI 12L14 steel grade. Body portion 12 has a first end 27 and a second end 29 and includes a first internal diameter 30 and an adjacent, smaller second internal diameter 31. Provided adjacent first end 27 is an internal slotted groove 30. At the juncture of diameter 30 and diameter 31 there is formed an internal shoulder position 34. The external surface of second end 29 is threaded as shown by reference character 36.

A circular retainer 38 is engagingly snapped into annular groove 21. Thereafter shaft portion 14 can be inserted into body portion 12. The shaft is maintained in a predetermined location by retainer 38 abutting shoulder portion 34. This arrangement positions first end 16 and second end 22 of shaft 14 within surrounding body portion 12 as shown in FIG. 1.

As shown in FIG. 1, tension means 15 includes a first circular spacer 40 that abuts retainer 38, a second circular spacer 42 and a helical spring 44 placed between these two spacers. The tension means is retained with first internal diameter 30 by a circular snap ring 46 that is inserted into slotted groove 32.

As thus constructed shaft portion 14 is maintained under tension within body portion 12, is further prevented from upward movement by the retainer and snap rings while downward movement can be achieved by exerting a force on flat end 16 sufficient to over come the spring tension provided by spring 44.

OPERATION OF THE INVENTION

Figure 4:
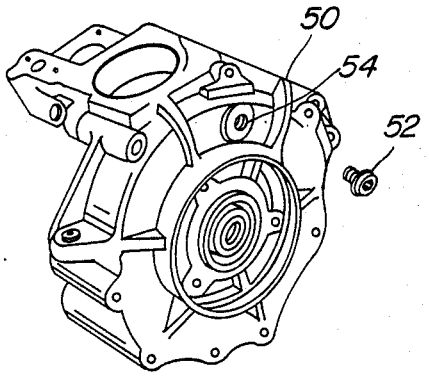
FIG. 4 is a perspective view of a motorcycle crankcase showing removal of the timing plug.

Referring to FIG. 4, there is shown a view of a motorcycle crankcase 50 with a threaded timing plug 50 removed from a threaded bore thereby exposing a timing inspection hole 54.

Figure 6:
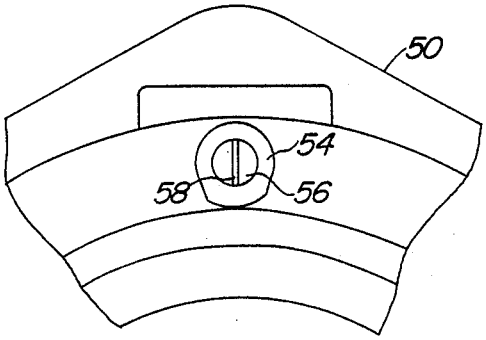
FIG. 6 is an enlarged front elevational view of a portion of a motorcycle crankcase shown in FIG. 4, wherein a flywheel and timing mark are shown.

As shown in FIG. 6, an enlarged view of crankcase 50, flywheel 56 is visible when viewed through inspection hole 54. A vertical timing mark 58 is inscribed onto the surface of the flywheel periphery, approximately a few millimeters deep. Thus, the mark is a vertical indentation on the flywheel periphery.

Figure 5:
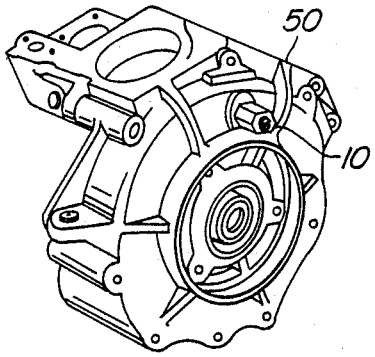
FIG. 5 is a perspective view of a motorcycle crankcase showing insertion of the flywheel locking apparatus into the crank case timing inspection hole.

FIG. 5 shows removal of timing plug 52 and threadably engaged in inspection 54 is apparatus 10. Threaded external surface 36 is threaded into the inspection hole until flat end 26 of shaft position 14 comes into contact with the surface of flywheel 56. The flat end is then positioned in a vertical plane by inserting a screw driver, or like tool, into slot 18 and slowly turning shaft portion 14 until slot 18 is in a vertical plane. Tension means 14 maintains flat end 26 in surface contact with flywheel 56 as the flywheel is slowly rotated. When the flywheel location containing timing mark 54 rotates into the area observed by the inspection hole, flat end 26 is forced into the timing mark indention by spring 44 contained within body portion 12. An audible "click" is heard, thus informing the person rotating the flywheel that the timing mark has been located. Ignition timing and setting of the circuit breaker contact point gap can now be performed on the engine.

Figure 11:
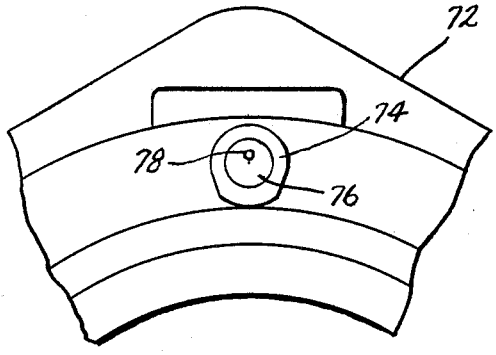
FIG. 11 is an enlarged front elevational view of a portion of a motorcycle crankcase shown in FIG. 4, wherein a flywheel and timing mark are shown.

The hereinabove description is particularly well suited for Harley Davidson motorcycles produced before 1981. These motorcycles were provided with a vertical timing mark 58 that is inscribed onto the surface of the flywheel periphery. Harley Davidson motorcycles produced after 1981 contain a different type of timing mark. As shown in FIG. 11, a small circular indentation 78 similar to a center-punch mark is provided on flywheel 76. Crankcase 72 also includes inspection hole 74 wherein apparatus 10 is threadably engaged.

Figure 8:
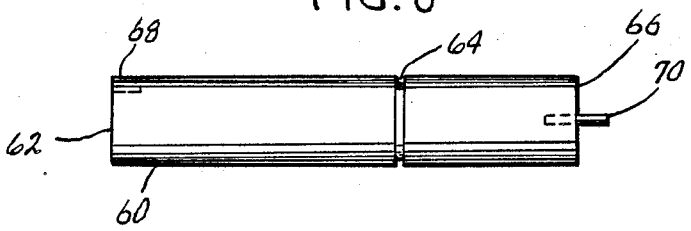
FIGS. 7 and 8 are end elevational views of shaft portions of the flywheel rocking apparatus of the present invention.
Figure 7:
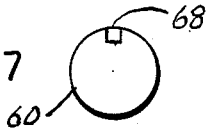

In the embodiment used for engines having a timing mark shown in FIG. 11, a different type of shaft portion is used. FIGS. 7 to 10 illustrate two types of shaft portions that are used to locate the FIG. 11 timing mark. FIGS. 7 and 8 show shaft portion 60 that includes a flat, first end 62, a longitudinal, cylindrical body portion 63, having an annular groove 64 and which terminates at second end 66. The first end is provided with a circumferential notch 68 for orientating the shaft portion as hereinafter more fully described. The second end further includes a longitudinal, pin-like cylindrical projection 70.

Figure 10:
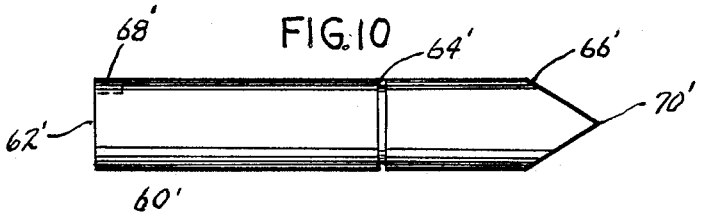
Figure 9:
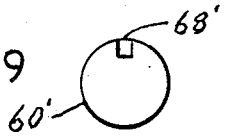

FIGS. 9 and 10 illustrate another construction for a shaft portion 60' that can be used with the invention described herein. This shaft portion includes a flat, first end 62' having a circumferential notch 68', a longitudinal, cylindrical body portion 63', having an annular groove 64' and which terminates at second end 66'. The second end is provided with a conical projection 70'.

Shaft portion 60 or 60' are adapted to be inserted into body portion 12. The shaft is maintained in a predetermined location by retainer 38 as previously described. Spacers 40 and 42, helical spring 44 and circular snap ring 46 complete the assembly of apparatus 10 suitable for locking a flywheel that contains a timing mark as illustrated in FIG. 11.

Apparatus 10 containing shaft portion 60 or 60' is threaded into inspection hole 74 until second end 66 or 66' comes into contact with the surface of flywheel 76. First end 62 or 62' is positioned so that orientation notch 68 or 68' is located at 12 O'Clock. Locating notch 68 or 68' at this position insures that projection 70 or 70' will be forced into timing mark 78 when the flywheel rotates into the area observed by the inspection hole. An audible "click" will be heard, thus informing the person rotating the flywheel that the timing mark has been located.

I claim:

1. A locking apparatus for locking a flywheel in a fixed position having a timing mark located there on and contained within a crank case having a bore, comprising:

(a) a hollow body portion adapted to be inserted into said bore;

(b) a shaft positioned within said body portion having an end adapted to fit in said timing mark; and (c) means to retain said shaft in a fixed position within said timing mark and prevent said flywheel from movement.

2. Locking apparatus as recited in claim 1, wherein said body portion includes:

a first end with a first internal diameter and having an internal annular groove adjacent said first end; and a second end with a smaller second internal diameter and an externally threaded surface.

3. Locking apparatus as recited in claim 1, wherein said shaft includes:

a flat first end having a slot positioned therein; a pair of concave sections positioned to form a narrow flat end surface at said end adapted to fit in said timing mark; and an annular groove having a first retaining means positioned in said groove.

4. Locking apparatus as recited in claim 3, wherein said first end slot and said end flat surface are in horizontal alignment.

5. Locking apparatus as recited in claim 3, wherein said means to retain said shaft comprises a first annular spacer placed adjacent said first retaining means;

a spring placed adjacent said first spacer: a second annular spacer placed adjacent said spring; and a snap ring inserted into a body portion annular groove for holding said spring within said body portion.

6. A locking apparatus for locking a flywheel in a fixed position having a timing mark located thereon and contained within a crankcase having a threaded bore, comprising:

(a) a hollow body portion having a first end with a first internal diameter, an internal annular groove, a second end with a smaller second internal diameter, a shoulder portion at the juncture of said first and second diameters and the surface of said second diameter being externally threaded;

(b) a shaft positioned within said body portion having a flat first end containing a diagonal slot, an annular groove having a retainer clip that contacts said body portion shoulder portion, a second end that terminates into a flat diagonal surface;

(c) a first annular spacer placed on said shaft, adjacent said retainer clip;

(d) a helical spring placed on said shaft, adjacent said first annular spacer;

(e) a second annular spacer placed on said shaft, adjacent said spring; and (f) a snap ring placed in said internal annual groove, adjacent said second annular spacer and thereby retaining said spring under tension within said body portion.

7. Locking apparatus as recited in claim 6, wherein said first end diagonal slot and said second end flat diagonal surface are in horizontal alignment.

* * * * *